US008671853B2

(12) United States Patent
Flaherty

(10) Patent No.: US 8,671,853 B2
(45) Date of Patent: Mar. 18, 2014

(54) ADJUSTABLE DESKTOP PLATFORM

(75) Inventor: Daniel Flaherty, Irving, TX (US)

(73) Assignee: Gemmy Industries Corporation, Coppell, TX (US)

( * ) Notice: Subject to any disclaimer, the term of this patent is extended or adjusted under 35 U.S.C. 154(b) by 0 days.

(21) Appl. No.: 13/642,651

(22) PCT Filed: Jul. 30, 2012

(86) PCT No.: PCT/US2012/048775

§ 371 (c)(1),
(2), (4) Date: Oct. 22, 2012

(87) PCT Pub. No.: WO2013/176690

PCT Pub. Date: Nov. 28, 2013

(65) Prior Publication Data

US 2013/0139736 A1 Jun. 6, 2013

Related U.S. Application Data

(60) Provisional application No. 61/651,101, filed on May 24, 2012.

(51) Int. Cl.
*A47B 11/00* (2006.01)

(52) U.S. Cl.
USPC ..... 108/138; 108/17

(58) Field of Classification Search
USPC ..... 108/17, 96, 95, 138, 65, 69, 43, 50.01, 108/50.02, 42, 48, 90
See application file for complete search history.

(56) References Cited

U.S. PATENT DOCUMENTS

| | | | | |
|---|---|---|---|---|
| 226,053 | A * | 3/1880 | Finnegan | 108/138 |
| 780,829 | A * | 1/1905 | Stengel | 108/138 |
| 2,406,436 | A * | 8/1946 | Peter | 108/17 |
| 2,630,359 | A * | 3/1953 | Schade | 108/136 |
| 2,913,122 | A * | 11/1959 | Lomas | 108/17 |
| 4,194,452 | A * | 3/1980 | Crowther et al. | 108/138 |
| 5,549,052 | A * | 8/1996 | Hoffman | 108/139 |
| 5,681,034 | A | 10/1997 | Noniewicz | |
| 5,823,120 | A | 10/1998 | Holmquist | |
| 6,220,660 | B1 * | 4/2001 | Bedro et al. | 108/44 |
| 6,907,829 | B2 * | 6/2005 | Bambach et al. | 108/65 |
| 7,201,108 | B2 * | 4/2007 | Eusebi et al. | 108/76 |
| 7,654,208 | B2 * | 2/2010 | Patten | 108/96 |
| 2004/0094072 | A1 * | 5/2004 | Fabian | 108/50.01 |
| 2005/0039643 | A1 | 2/2005 | Dailey | |
| 2007/0163475 | A1 | 7/2007 | Murphy | |
| 2008/0203865 | A1 | 8/2008 | Chouinard et al. | |
| 2011/0155023 | A1 | 6/2011 | Krause et al. | |

OTHER PUBLICATIONS

International Search Report Issued Oct. 26, 2012 in related International Patent Application No. PCT/US2012/048775.
Written Opinion issued Oct. 26, 2012 in related International Patent Application No. PCT/US2012/048775.

* cited by examiner

*Primary Examiner* — Jose V Chen
(74) *Attorney, Agent, or Firm* — Venable LLP; Steven J. Schwarz

(57) ABSTRACT

An adjustable desktop workspace is disclosed having a base having a lower platform, an upper platform, and two pivoting arms mounted between the two. Each pivoting arm has a front and rear bracket. A locking lever on each arm fixedly engages the platform in an upright position at a variety of levels above the lower platform. There are also two stabilizing bars to limit side-to-side relative movement, and a biasing spring between the front and rear brackets to aide moving the upper platform.

20 Claims, 4 Drawing Sheets

ADJUSTABLE DESKTOP PLATFORM

BACKGROUND OF THE INVENTION

Technical Field

This application relates generally to ergonomic workplace environments, and more particularly to an adjustable desktop platform.

Sitting for long periods of time during the work day is not good for one's health and wellness. Medical studies show that sitting increases the rate of all-cause mortality, especially from cardiovascular disease, diabetes and obesity, for example. People who sit for most of the day are 50 percent more likely to die of heart attacks. Even if you exercise, the longer you sit the greater the chances you will die. Sitting shuts down the circulation of the fat-absorbing enzyme lipase, while standing up engages muscles and promotes the distribution of lipase, which prompts the body to process fat and cholesterol, independent of the amount of time spent exercising.

There are desks available to be used while standing, and even desks adapted for use while a user is on a treadmill.

However, standing for very long periods of time to work is more tiring, dramatically increases the risks of carotid atherosclerosis because of the additional load on the circulatory system, and increases the risks of varicose veins.

Taking regular breaks from sitting for prolonged periods of time can have several positive outcomes. For example, standing can provide more energy during the work day. In addition, because standing burns more calories than sitting, standing can also result in weight loss without changes in diet or exercise. It is also harder to become more tired or lose focus when standing.

Because regular breaks from sitting are beneficial, and because many people during the work day want to remain productive while taking breaks from sitting, and because everyone will sit and stand for different lengths of time at different times during the day, there exists a need to create a work environment that is ergonomic for someone standing as well as sitting, and allows the transition to be easy, quick and simple.

BRIEF SUMMARY

An advantage of the present invention is to provide an adjustable desktop platform that can transition between a lower operating position and an upper operating position quickly, easily and simply.

A related advantage of the present invention is to provide an adjustable desktop platform that can transition between a lower operating position and a variety of higher positions.

Another advantage of the present invention is to provide an adjustable desktop platform that can convert existing desktop workspaces to height-adjustable workspaces.

In accordance with an embodiment of the present invention, an adjustable desktop workspace comprises a base having a lower platform; an upper platform; two pivoting arms mounted between the base and the upper platform, each pivoting arm further comprised of a front and rear bracket; and a locking lever on each arm for fixedly engaging the platform in an upright position.

In accordance with another embodiment of the present invention, an adjustable desktop workspace comprises an upper and lower platform hingedly connected by a first and second arm assembly; the first and second assembly comprised of a front and rear member; the members each having a first end and a second end, wherein said first end is connected to the base, and wherein the second end is connected to said platform; the front member is operably engaged to the rear member by a biasing mechanism; and a lever for locking engagement of the first and second arm assembly in an upright position.

Other objects and advantages will become apparent from the following descriptions, taken in connection with the accompanying drawings, wherein, by way of illustration and example, an embodiment of the present invention is disclosed.

BRIEF DESCRIPTION OF THE FIGURES

Embodiments of the invention and its use will be understood by reference to the following detailed description when read in conjunction with the accompanying Figures wherein.

DETAILED DESCRIPTION

Detailed description of embodiments is provided herein. It is to be understood, however, that the present invention may be embodied in various forms. Various aspects of the invention may be inverted, or changed in reference to specific part shape and detail, part location, or part composition. Therefore, specific details disclosed herein are not to be interpreted as limiting, but rather as a basis for the claims and as a representative basis for teaching one skilled in the art to employ the present invention in virtually any appropriately detailed system, structure or manner.

This specification outlines the development of an ergonomic work environment to allow a user to work while sitting or standing, and to transition between the two positions easily, quickly and simply.

Embodiments of the invention use an adjustable desktop platform along with a system of spring aided pivoting arms and a multi-positional, adjustable, locking mechanism to raise and lower the desktop platform to provide a work space at a level useable for someone in a sitting position, and transition to provide a work space useable for someone in a standing position. Embodiments of the invention include counterweights, covers and supports for added safety.

Figure 1:
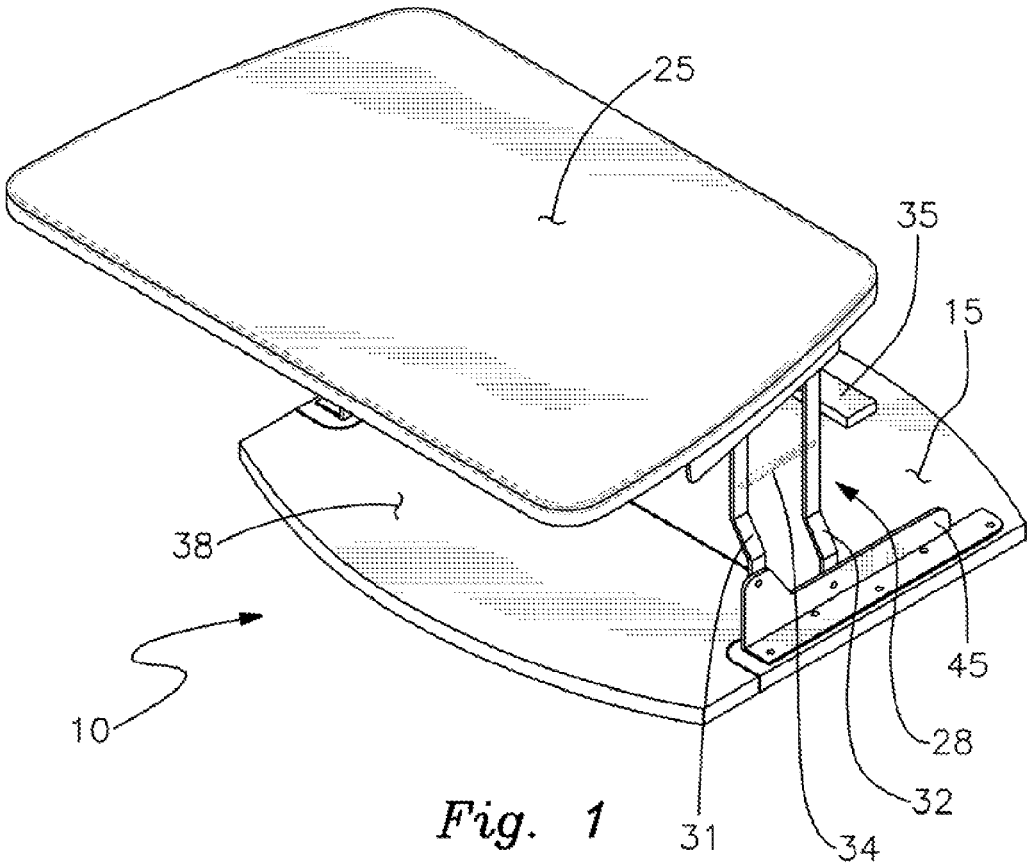
FIG. 1 is a perspective, cutaway view of an embodiment of the adjustable desktop platform invention shown in fully upright position.
Figure 2:
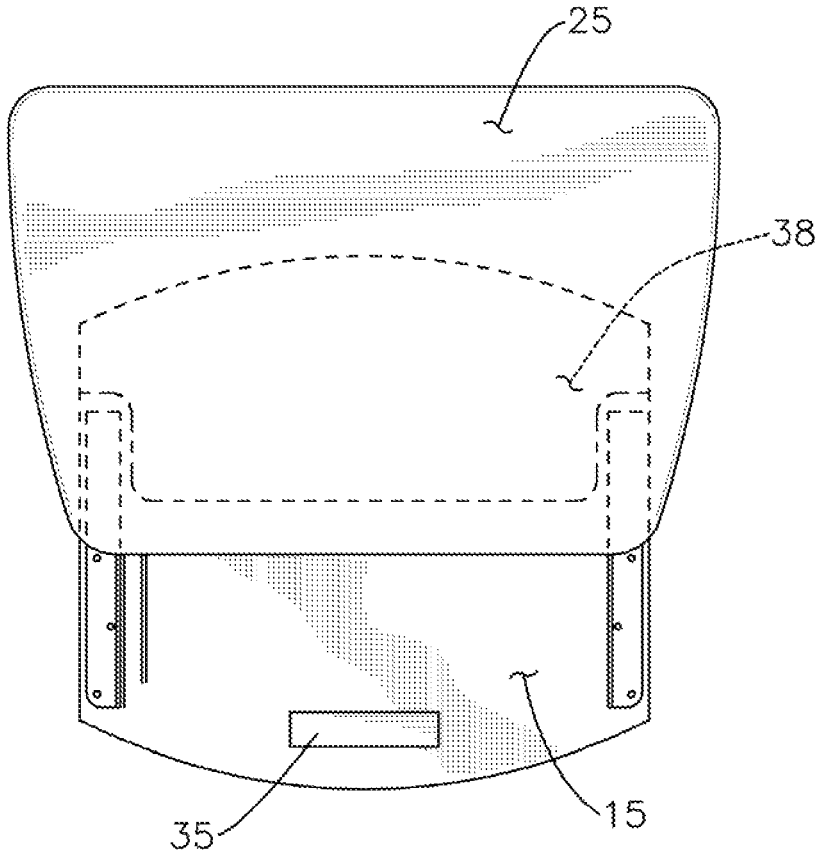
FIG. 2 is a top view of the embodiment of FIG. 1.

Turning first to FIG. 1, there is shown an adjustable desktop platform 10 according to an illustrated embodiment of the invention. Adjustable desktop platform 10 includes a base platform 15 intended to set on an existing worker's desk. The desktop platform 25 is separated from base-platform 15 by a predetermined space. The space between base platform 15 and desktop platform 25 can be large enough to store a computer keyboard and mouse, and allow for the use thereof. In addition, shown in FIG. 1 is a spring-loaded pivoting bracket assembly 28 connecting base platform 15 and desktop platform 25. Pivoting bracket assembly 28 can include pivoting arms located near each lateral side of the platforms 15, 25, with each pivoting arm including front and rear brackets 32, 31. As will be described in connection with FIG. 5, below, a locking mechanism is also included so as to prevent the unintended change in position of adjustable desktop platform 10, as well as allow the stability of adjustable desktop platform 10 to support a laptop computer, computer monitor, keyboard and/or computer mouse, among other items.

In the lowered position, pivoting brackets 31 and 32 are in a generally horizontal position and desktop platform 25 is over base platform 25, whereas in the fully upright position, desktop platform 25 is raised with pivoting brackets 31 and 32 in the generally vertical position. In the fully upright position, desktop platform 25 is also moved forward closer to the user, relative to base platform 15. Because desktop platform 25 is designed to be used in a workspace environment, and would likely have computer equipment such as screen, keyboard and mouse thereon, the added forward weight is counterbalanced by counterweight 35 shown towards the far end of base platform 15. As will be appreciated, the specific weight of counterweight 35 can be modified to the particular applications and may depend on the weight of the desktop, the length of the pivoting arms and the shape of the desktop platform, among other things.

Figure 3:
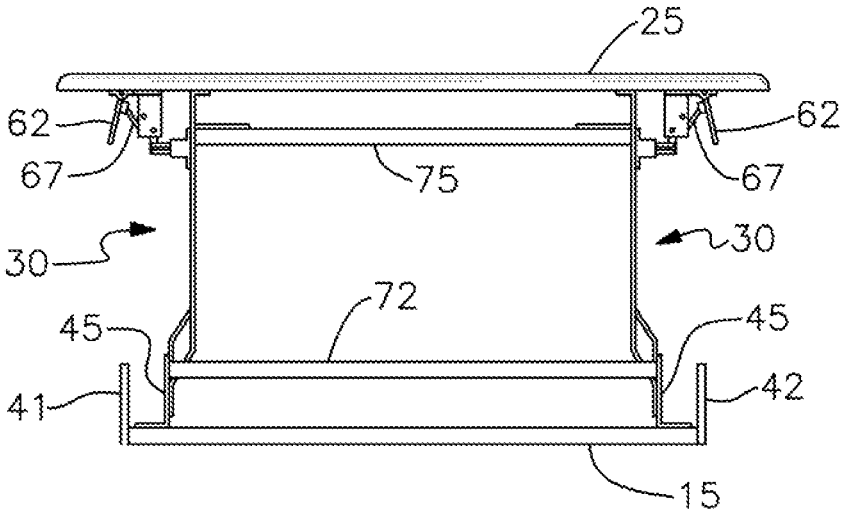
FIG. 3 is a front view of the embodiment of the invention shown in FIG. 1.
Figure 5:
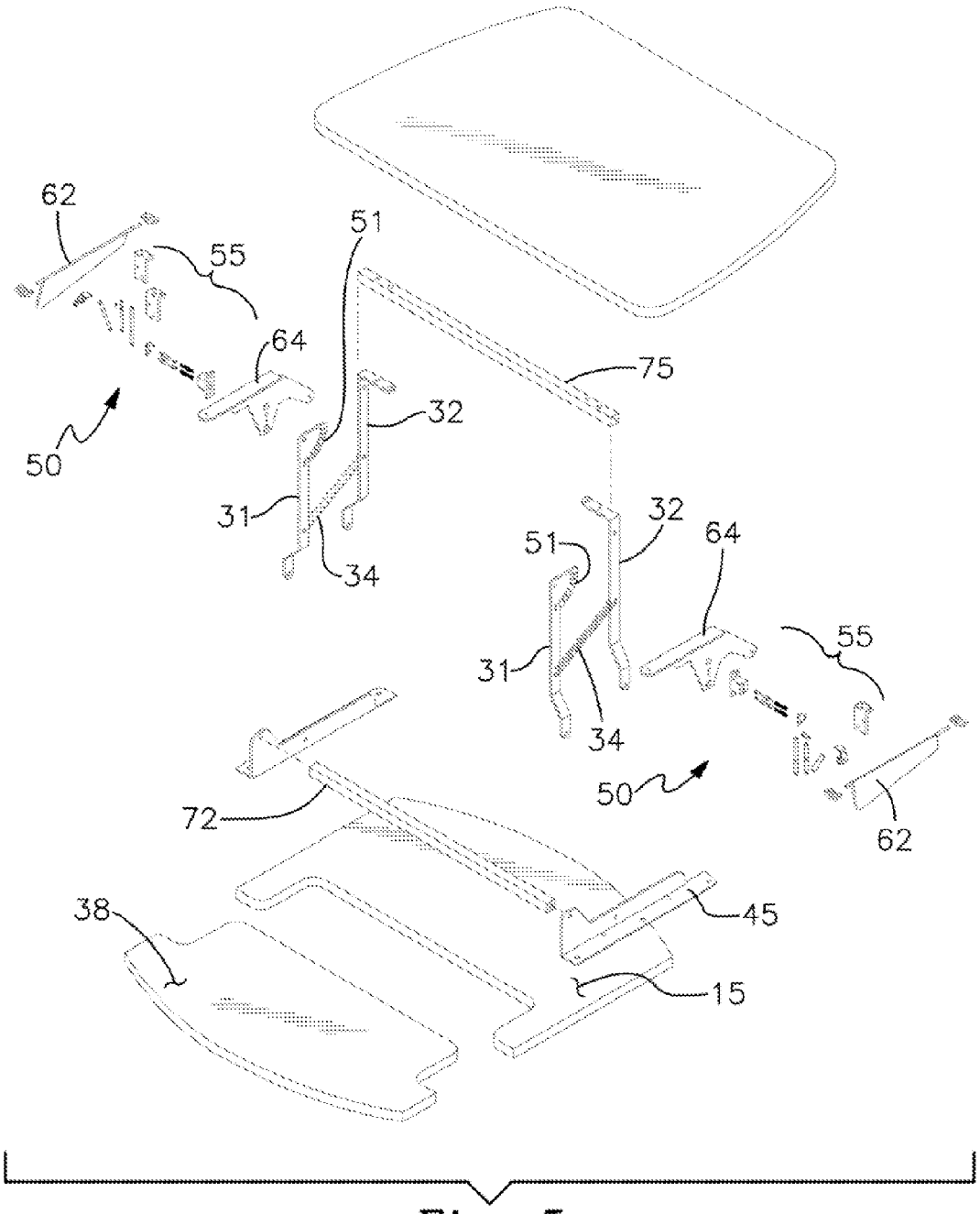
FIG. 5 is an exploded view of the preferred embodiment of the adjustable desktop platform shown in FIG. 1.

As is shown in FIG. 1 and FIG. 5, base platform 15 may also include a removable insert 38. Removable insert 38 can easily be removed or inserted depending upon the user's individual preferences for their workspace. As shown in FIG. 3, but omitted in other figures to allow the illustration of other mechanical features, there are also included side covers 41 and 42 on the side ends of base platform 15. Side covers 41 and 42 provide a safety feature so that when a user is adjusting desktop platform 10 up or down, the user's fingers and/or other things are less likely to get caught in the moving mechanism. Further, side covers 41 and 42 provide an aesthetically pleasing view, rather than a user seeing the mechanical assemblies.

Figure 4:
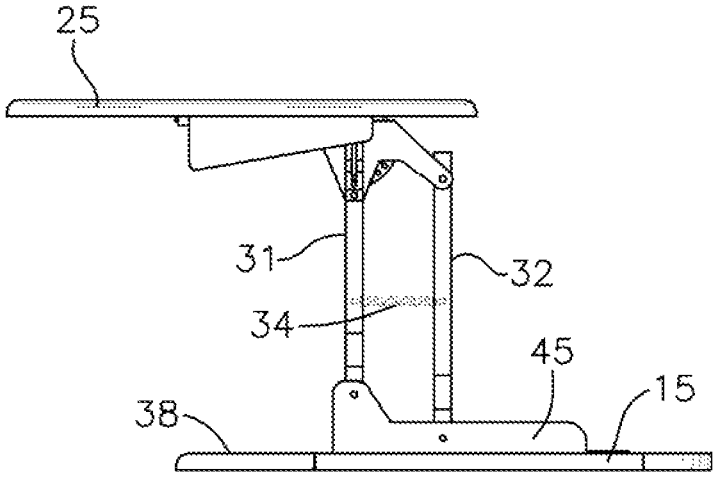
FIG. 4 is a side view of the embodiment of the invention shown in FIG. 1.

Turning next to FIG. 3, FIG. 4 and FIG. 5, there is shown in more detail the adjusting mechanism of the present invention. Specifically, in FIG. 3, left and right pivoting brackets 28 are shown. Each pair of pivoting brackets 28 includes a forward multi-positional, adjustable pivoting bracket 31, as well as a rear stabilizing pivoting bracket 32 as shown in FIG. 4. Each bracket is secured to base platform 15 and the desktop platform 25 through the generally L-shaped attaching brackets 45 shown, which are secured to the respective platforms through, for example, screws.

Springs 34 are also included to assist the user in countering the weight of the desktop platform 25 and any material thereon, such as a computer, screen, keyboard and mouse, to allow for smooth, easy raising and lowering of the desktop platform. Springs 34 are shown in FIG. 5. Each spring 34 is connected between forward pivoting bracket 31 and rear pivoting bracket 32. In the fully upright position, springs 34 are in the natural, relaxed position, and in the fully lowered position, springs 34 are in the stretched position. Alternate spring-assisted designs are readily appreciated. As will be appreciated, the size, length, and spring force of the springs can be chosen for the particular anticipated environment, including the desktop weight, the anticipated weight of material on the desktop, the strength of the users, etc.

For additional security and stability, there is also included a locking mechanism 50, which also secures desktop platform 25 at a variety of distances from base platform 15. This feature is accomplished by the series of holes 51 in each of forward pivoting brackets 31. The series of holes 51 interacts with the pins and brackets 55 as shown in detail in FIG. 5. These pins fit in forward pivoting bracket holes 51 and prevent further movement of the desktop platform relative to the base platform. The pins are inserted into and removed from holes 50 by the levers 62 on either side of desktop platform 25 and are secured to the underside of desktop platform 25 by retaining brackets 64. Each lever 62 is connected by a wire 67 to pins such that by movement of the lever, the pins may be inserted into or removed from the holes of forward pivoting bracket 31. The wire is not shown in FIG. 5, so as to not obscure the remaining features, though is understandable by those in the art. In the preferred embodiment, lever 62 is connected by wire 67 to the near set of pins, though may be connected to the far set of pins, depending upon the desired design and environment.

Forward lateral stabilizing bar 72 and rear lateral stabilizing bar 75 or supports are also shown in FIG. 5 and are employed to help reduce unwanted side-to-side relative movement between base platform 15 and desktop platform 25.

While the invention has been described in connection with some preferred embodiments, it is not intended to limit the scope of the invention to the particular form set forth, but on the contrary, it is intended to cover such alternatives, modifications, and equivalents as may be included within the spirit and scope of the invention as defined by the currently or later appended claims.

What is claimed is:

1. An adjustable desktop workspace comprising:

a. a base having a lower platform defining a substantially flat lower work surface, the lower platform being without legs and adapted to sit on an existing desk;

b. a substantially planar upper platform, the upper platform defining a substantially flat, unobstructed upper work surface;

c. a first pivoting arm mounted between said base and said upper platform, said first pivoting arm comprising a first front bracket and a first rear bracket, the first front bracket and first rear bracket movable between a position substantially parallel to the lower platform and a position substantially perpendicular to the lower platform;

d. a second pivoting arm mounted between said base and said upper platform, said second pivoting arm comprising a second front bracket and a second rear bracket, the second front bracket and the second rear bracket movable between a position substantially parallel to the lower platform and a position substantially perpendicular to the movable platform, wherein the upper platform is in a lowered position substantially parallel to the lower platform when the first and second front brackets and first and second rear brackets are substantially parallel to the lower platform, and the upper platform is in a raised position substantially parallel to the lower platform when the first and second front brackets and first and second rear brackets are substantially perpendicular to the lower platform; and e. a first locking lever associated with the first pivoting arm, the first locking lever adapted to immobilize at least one of the first front bracket or the first rear bracket at a plurality of locations, to lock the upper platform in the raised position and in at least one position between the lowered position and the raised position;

wherein the upper platform moves rearward with respect to the lower platform when moved from the lowered position to the raised position, and the lower platform includes a counterweight adapted to offset weight of the upper platform when in the raised position.

2. An adjustable desktop workspace as claimed in claim 1 further comprising a removable inset in the base.

3. An adjustable desktop workspace as claimed in claim 1 further comprising:

one or more lateral stabilizing bars.

4. An adjustable desktop workspace as claimed in claim 3 wherein the one or more lateral stabilizing bars include a rigid bar connecting the first front bracket to the second front bracket.

5. An adjustable desktop workspace as claimed in claim 4 wherein the one or more lateral stabilizing bars further include a second rigid bar connecting the first rear bracket to the second rear bracket.

6. An adjustable desktop workspace as claimed in claim 1 further comprising:

a biasing connection adapted to bias the upper platform toward the raised position.

7. An adjustable desktop workspace as claimed in claim 6 wherein the biasing connection comprises at least a first spring connecting at least the first front bracket with the first rear bracket.

8. An adjustable desktop workspace as claimed in claim 7 wherein the biasing connection comprises a second spring connecting the second front bracket with the second rear bracket.

9. An adjustable desktop workspace as claimed in claim 1, wherein the base is free-standing and adapted to rest upon another surface.

10. An adjustable desktop workspace as claimed in claim 1, further comprising a second locking lever associated with the second pivoting arm, the second locking lever adapted to immobilize at least one of the second front bracket or the second rear bracket at a plurality of locations, to secure the upper platform in the raised position and in at least one position between the lowered position and the raised position.

11. An adjustable desktop workspace as claimed in claim 1, further comprising a counterweight located on the lower platform, the counterweight offset rearward from the upper platform when the upper platform is in the raised position.

12. An adjustable desktop workspace comprising:

a. a substantially planar upper platform and a lower platform hingedly connected by a first arm assembly and a second arm assembly, said upper platform defining a substantially flat, unobstructed upper work surface and said lower platform defining a substantially flat lower work surface, wherein said lower platform is without legs and adapted to sit on an existing desk;

b. said first arm assembly comprising a first front member and a first rear member, and said second arm assembly comprising a second front member and a second rear member;

c. the first and second front bracket and the first and second rear bracket movable between a position substantially parallel to the lower platform and a position substantially perpendicular to the lower platform, wherein the upper platform is in a lowered position substantially parallel to the lower platform when the first and second front brackets and first and second rear brackets are substantially parallel to the lower platform, and the upper platform is in a raised position substantially parallel to the lower platform when the first and second front brackets and first and second rear brackets are substantially perpendicular to the lower platform;

d. a biasing mechanism extending between the first front bracket and the first rear bracket, the biasing mechanism being in a relaxed state when the first front bracket and first rear bracket are substantially perpendicular to the lower platform; and e. a first lever adapted to lock said first front bracket and said first rear bracket substantially perpendicular to the lower platform;

wherein the upper platform moves rearward with respect to the lower platform when moved from the lowered position to the raised position, and the lower platform includes a counterweight adapted to offset weight of the upper platform when in the raised position.

13. An adjustable desktop workspace as claimed in claim 12 further comprising:

one or more lateral stabilizing bars.

14. An adjustable desktop workspace as claimed in claim 13 wherein the one or more lateral stabilizing bars include a rigid bar connecting the first front bracket to the second front bracket.

15. An adjustable desktop workspace as claimed in claim 14 wherein the one or more lateral stabilizing bars further include a second rigid bar connecting the first rear bracket to the second rear bracket.

16. An adjustable desktop workspace as claimed in claim 12 wherein the biasing mechanism comprises a spring connecting the first front bracket to the first rear bracket.

17. An adjustable desktop workspace as claimed in claim 12 wherein the lever is adapted to lock the upper platform in the raised position and in at least one position between the lowered position and the raised position.

18. An adjustable desktop workspace as claimed in claim 12, wherein the base is free-standing and adapted to rest upon another surface.

19. An adjustable desktop workspace as claimed in claim 12, further comprising a second lever adapted to lock said second front bracket and said second rear bracket substantially perpendicular to the lower platform.

20. An adjustable desktop workspace as claimed in claim 12, further comprising a counterweight located on the lower platform, the counterweight offset rearward from the upper platform when the upper platform is in the raised position.

* * * * *

UNITED STATES PATENT AND TRADEMARK OFFICE

CERTIFICATE OF CORRECTION

PATENT NO. : 8,671,853 B2
APPLICATION NO. : 13/642651
DATED : March 18, 2014
INVENTOR(S) : Flaherty et al.

It is certified that error appears in the above-identified patent and that said Letters Patent is hereby corrected as shown below:

Title Page, Item (12) delete "Flaherty" and insert --Flaherty et al.--.

Title Page, Item (75) Inventor, should read

--(75) Inventors: Daniel Flaherty, Irving, TX (US);
Sheng Chien Wang, Taichung City (TW)--.

Signed and Sealed this
Twenty-first Day of June, 2016

Michelle K. Lee

Michelle K. Lee
*Director of the United States Patent and Trademark Office*